US007954543B2

(12) United States Patent
Hernandez et al.

(10) Patent No.: US 7,954,543 B2
(45) Date of Patent: Jun. 7, 2011

(54) HEAT EXCHANGER HEADER WITH DEFORMATIONS

(75) Inventors: Eduardo Hernandez, San Luis Potosi (MX); Blas Gutierrez, San Luis Potosi (MX); Felipe Trejo, San Luis Potosi (MX); Victor-Manuel Minero, San Luis Potosi (MX)

(73) Assignee: Valeo Sistemas Electricos, San Louis Potosi (MX)

( * ) Notice: Subject to any disclaimer, the term of this patent is extended or adjusted under 35 U.S.C. 154(b) by 1267 days.

(21) Appl. No.: 11/298,869

(22) Filed: Dec. 9, 2005

(65) Prior Publication Data

US 2006/0137866 A1 Jun. 29, 2006

Related U.S. Application Data

(60) Provisional application No. 60/635,215, filed on Dec. 10, 2004.

(51) Int. Cl.
*F28F 9/02* (2006.01)
*B23P 21/00* (2006.01)

(52) U.S. Cl. ..... 165/149; 165/906; 29/890.052

(58) Field of Classification Search ..... 165/149
See application file for complete search history.

(56) References Cited

U.S. PATENT DOCUMENTS

| | | | | |
|---|---|---|---|---|
| 4,461,348 | A | 7/1984 | Toge et al. | |
| 4,649,628 | A * | 3/1987 | Allemandou | 165/148 |
| 4,917,182 | A * | 4/1990 | Beamer | 165/173 |
| 5,944,095 | A * | 8/1999 | Fukuoka et al. | 165/173 |
| 6,644,385 | B2 * | 11/2003 | Boissele et al. | 165/79 |
| 7,156,401 | B2 * | 1/2007 | Merklein et al. | 277/641 |
| 2005/0039894 | A1 * | 2/2005 | Brost et al. | 165/149 |

FOREIGN PATENT DOCUMENTS

EP 54815 A1 * 6/1982

* cited by examiner

*Primary Examiner* — Allen J Flanigan
(74) *Attorney, Agent, or Firm* — Dierker & Associate, P.C.

(57) ABSTRACT

The present invention has its object to provide a heat exchanger with plastic tanks type, wherein a seal member is regularly compressed and hooks or tabs of header core crimped in a uniform fashion.
Deformations predominantly located in the large sides or sides adjacent to the tank foot of the header, are formed and distributed in the inner or outer wall. The deformations in the periphery, or more particular, on the outside of the header wall, are formed after the brazing process.

19 Claims, 13 Drawing Sheets

$X_1 - X_1$

Y–Y

HEAT EXCHANGER HEADER WITH DEFORMATIONS

This patent application claims priority of provisional application No. 60/635,215 filed Dec. 10, 2004

FIELD OF THE INVENTION

The present invention relates to the field of heat exchangers, and, in particular, heat exchangers with plastic tanks.

BACKGROUND OF THE INVENTION

Modern heat exchangers are often made of aluminum or aluminum alloy, at least in their core and header portions. Aluminum heat exchangers often use plastic end tanks or manifolds that are mechanically assembled by a bending or crimping process. The crimp most often consists of a deformation on the header tabs that produces an interference with the plastic tanks. This allows the assembly of the header plus the end tank in a way to produce a hermetically sealed or hermetic system by compressing a rubber seal (gasket) in this area to form a seal. By assembly in this manner, the heat exchanger is able to stay sealed and support even elevated internal pressures during the operation of the heat exchanger. Examples of prior art heat exchangers are found in U.S. Pat. No. 4,461,348 Jul. 24, 1984, Toge et al, with FIGS. 1-4 showing the crimped 'hooks', tank feet and header positioning in radiators.

Aluminum braze processes used in the production of heat exchangers have many advantages, but also have the disadvantage that the strength gained during the cold (non thermally-heated) work of the header is lost due to the re-crystallization of micro structures during the brazing. Material gets a normalization status.

In order to resist the stresses produced by the pressure, thicker materials have been used. However, these thicker materials mean a significantly negative impact from both a cost and a crimping process point of view.

Generally, conventional radiators for automotive engines are composed of a core unit having metallic tubes and corrugated fins connected with each other by welding in a heat transmitting manner, and an upper and a lower core plate or header connected to both ends of the tubes. Each of the core plates or headers is formed with a holding groove along its periphery.

BRIEF DESCRIPTION OF THE INVENTION

In view of the above disadvantages of the prior art, preferred embodiments of the present invention provide a heat exchanger, wherein a seal member is regularly compressed and tabs or hooks of headers are bent (crimped) in a uniform fashion.

A heat exchanger of the present invention is preferably a heat exchanger useful in automotive application, more preferably a radiator or charger air cooler, (CAC), more preferably a charge air cooler or the like. Preferred embodiments of the present invention useful in automotive vehicles, are heat exchangers with cores and headers made of aluminum or aluminum alloys in processes such as the CAB process, that has a header (collector) with side wall on its periphery for receiving a seal member as well as a plastic tank member, wherein deformations (for example in the large sides of the side wall) are presented in the inner or outer wall. Non limiting examples of deformations can include notches, grooves, or protuberances, elevations, ribs, or the like depending which can be present on the interior or exterior of the tank. The deformations in the periphery of the header wall are preferably made after the brazing process. This prevents the reduction of the stiffness gained on the hardening of the stamping in cold work, and associated increase in product life span.

As stated above, preferred embodiments of the present invention relate to a heat exchanger, and more particularly a heat exchanger with plastic end tanks, having particular use in radiator or charge air cooler applications, as a radiator or charger air cooler dissipating heat from cooling fluid for engines or gas, preferably, air from the turbo chargers of automotive vehicles.

Preferred embodiments of the present invention provide additional strength to the headers of the core, without using the solutions such as overall thickening of materials. The header has a header portion connected to or otherwise attached or fixed (hereinafter 'fixed') to the core portion. The present invention advantageously provides a method for increasing the strength of the materials without such thickening, while retaining the advantage of increased pressure resistance and increased durability of the heat exchanger, even under repetitive cycles of pressure.

The durability of the heat exchangers with this type of design, preferably with plastic tanks, depends to a large extent on the strength of the crimping. Stresses produced by the internal pressure on the heat exchanger are distributed along the periphery of the header. The header tabs that hold the tanks, and, subsequently, the seat of the header, suffer stress. This effect is more significant when size increases, i.e. size of the tanks, width and height are larger.

The present invention provides for a way of strengthening or reinforcing the area of or around the header joint of heat exchanger assemblies. The present invention, by providing for deformations, such as grooves, notches, projections or deformations, on the header, and, in particular grooves or notches, in or on the side wall of the header, increase the stiffness of the side wall. This increase in stiffness consequently produces additional strength at the header to tank joint to a level that even in highly elevated stress and pressure conditions, the crimping joint, is able to resist (not burst or otherwise bulge) to an extent where it withstands the internal pressure, and the heat exchanger header to joint remains intact.

Preferred embodiments of the present invention, therefore, provide for increased pressure resistance at the header to tank joint, particularly at the header to tank crimp joints, of the heat exchanger without any subsequent increase in material thickness. In more preferred embodiments, the overall material thickness, particularly in the header side wall, can even be reduced proportionally without any significant effect on pressure resistance.

Preferred embodiments of the present invention also foresee adaptations and/or modification of the process operations for making heat exchanger assemblies. In preferred methods of the present invention, in the steps of the process operation, at least one deformation, and, preferably, a plurality of deformations is added to the header side wall after, in the case of brazed headers, the brazing process, without major effect on either the timing or effectiveness of the heat exchanger assembly process.

In preferred method embodiments of the present invention, the process to build the deformations into to the header material is done with a subsequent increase in the strength of the header physical properties. In most preferred embodiments, this deformation addition step in the process must be performed after the brazing to obtain the maximum advantage.

Preferred process operations produce deformations on the header side walls of the core. These deformations increase the strength of the core to resist pressure to a greater degree, especially under areas of high stress, than non-deformed header side walls. As described above, the processes in accordance with the present invention produce deformations, such as ribs projections, or the like, particularly deformations on the side walls of the header that increase stiffness of the material.

The deformations on the side walls of the header are, preferably, formed by applying pressure or 'compressing' on the exterior or interior, preferably from the exterior surface towards the interior surface, to push the deformations inward in the header. Such deformations are preferably formed such that the deformations extend into the surface or are inward facing as opposed to projecting out of or outward facing the outer surface of the side walls of the header. Deformations on the side walls of the header are also spaced in a fashion to provide maximum support for the heat exchanger core at the header to tank joint. Most preferred are deformations that extend inwardly towards the interior of the header. Also most preferred are deformations that are formed after brazing, particularly in aluminum based cores with headers.

The deformations are even more preferably spread out on the side wall at either regular or irregular intervals along the side wall. Most preferably the deformations are spread out at intervals such that at least one of the deformations occurs at an area of the radial area of the header. Where a header is crimped with tabs or hooks (hooks) to a plastic tank, deformations are also even more preferably located at least one area at or near the hooks of the header that are crimped onto the plastic tanks.

In preferred embodiments of the present invention, the deformations are added to the header side wall at the area where the plastic tank foot is crimped onto, or a joint is formed between, the tank foot and the header. Areas of high stresses and under internal pressure of the heat exchanger often occur at the area of the header, tank foot and the gasket seal between the foot and the header of the core. Preferably, the deformations of the present invention are located along the header side wall that runs on the side of or essentially parallel with, or at least adjacent to the tank foot above the area of the gasket seal, or at the area of highest stress at the folds of the side wall if there are crimped joints.

DESCRIPTION OF THE PREFERRED EMBODIMENTS

Referring to FIGS. 1-7, deformations (26) are added, preferably by a jig, to the side wall tab (hook) of the header (10). Interior surface of header (2) is shown.

Figure 1:
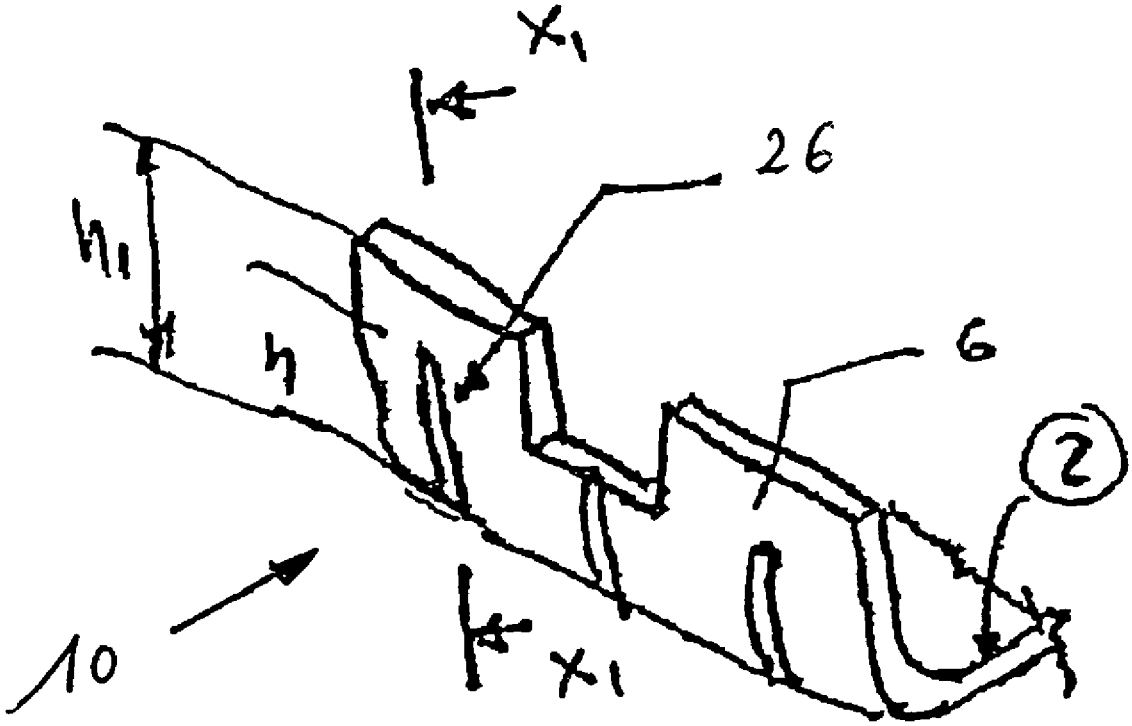
FIG. 1 is a sectional perspective outside view of the header with deformations on the outer side of the wall.
Figure 2:
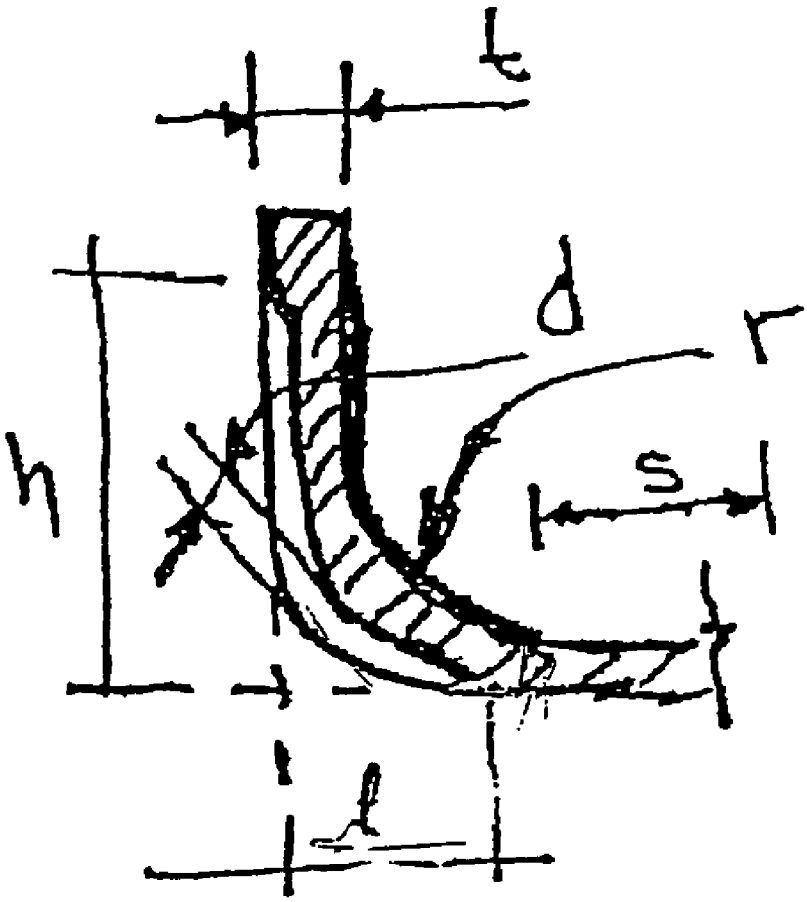
FIG. 2 Is a cross sectional view of the deformations of FIG. 1 on the outer side of the header wall.
Figure 3:
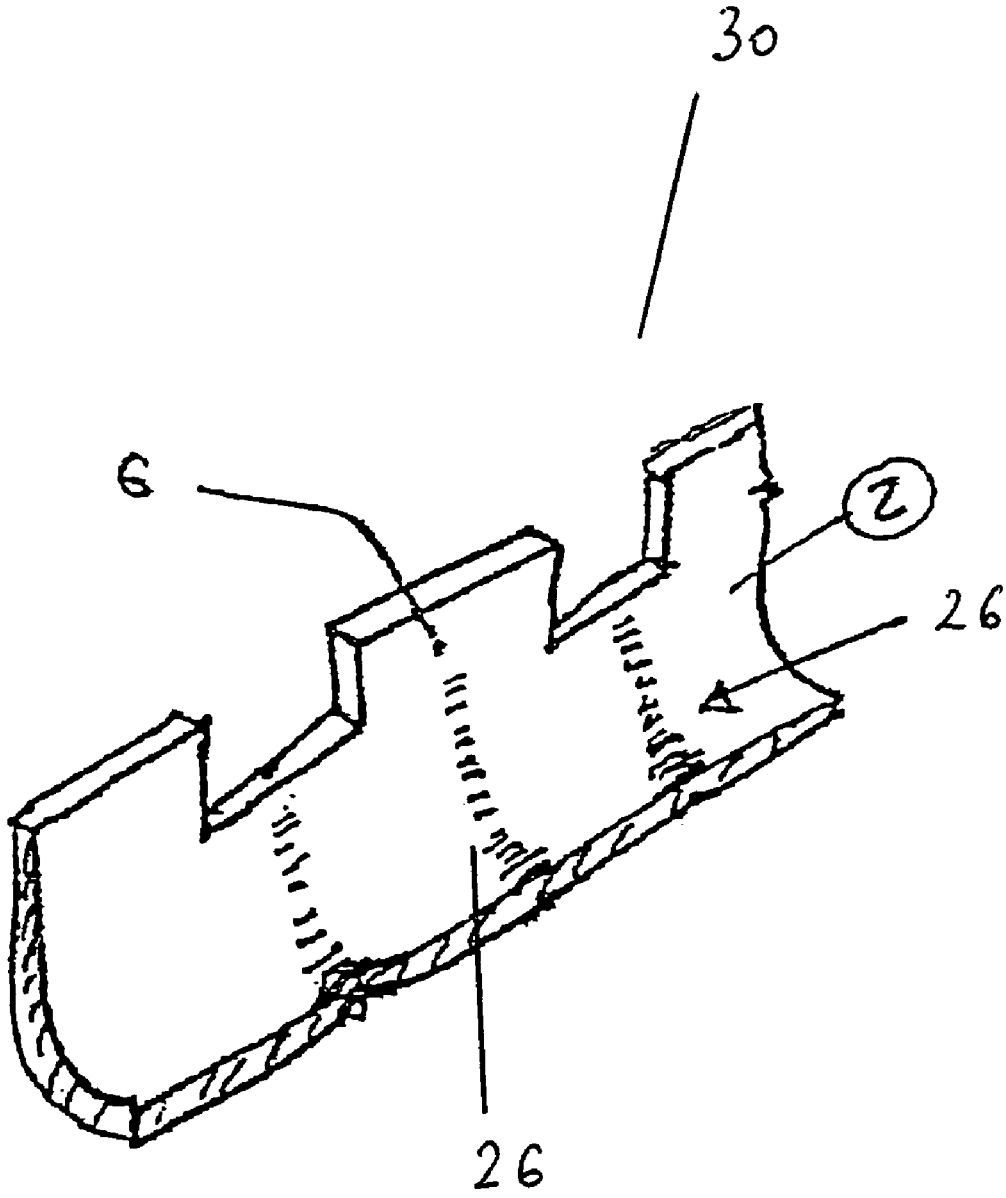
FIG. 3 Is a sectional perspective inside view of the header with deformations shown originating from on the outer side of the wall.
Figure 4:
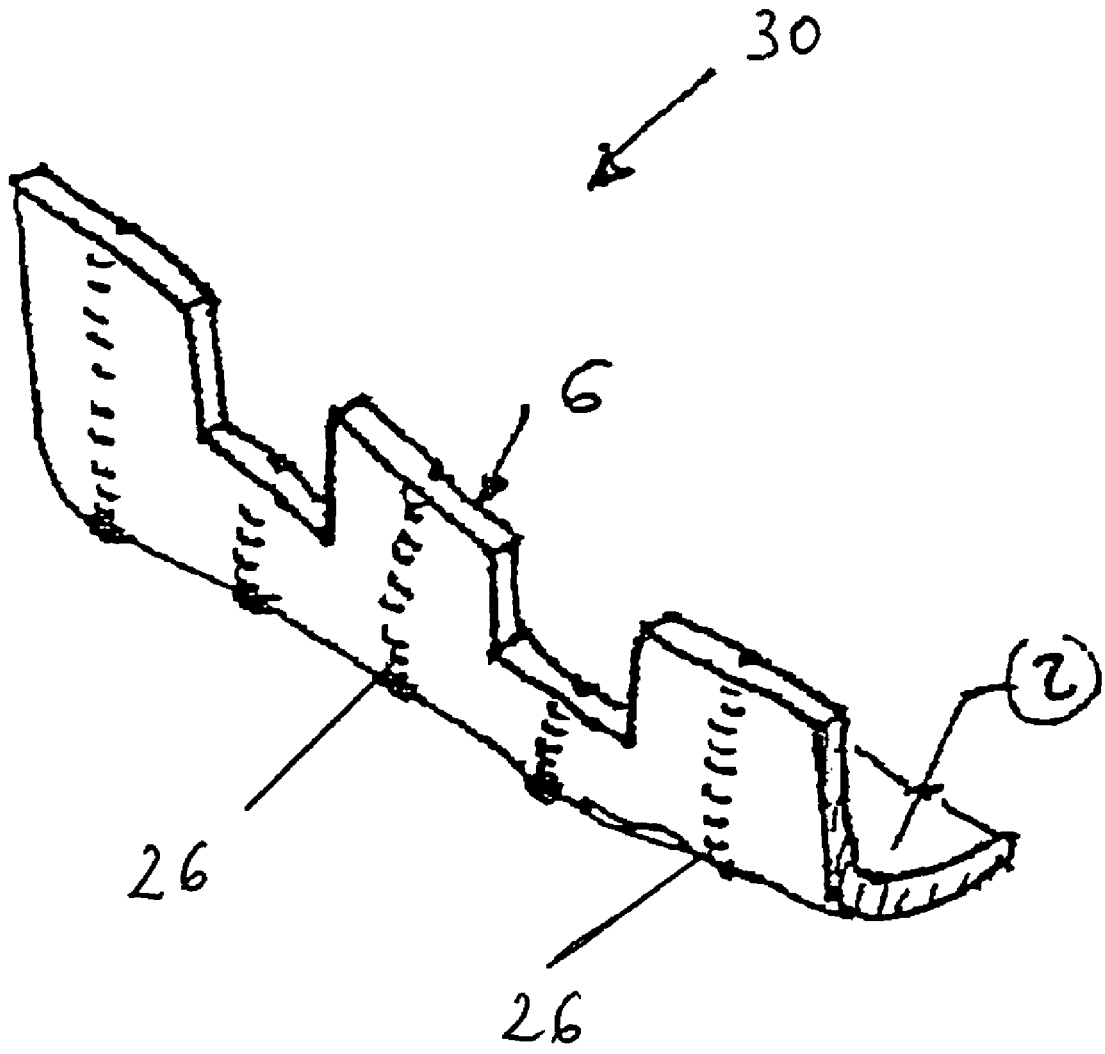
FIG. 4 Is a sectional perspective outside view of the header with deformations on the inner side of the wall.
Figure 5:
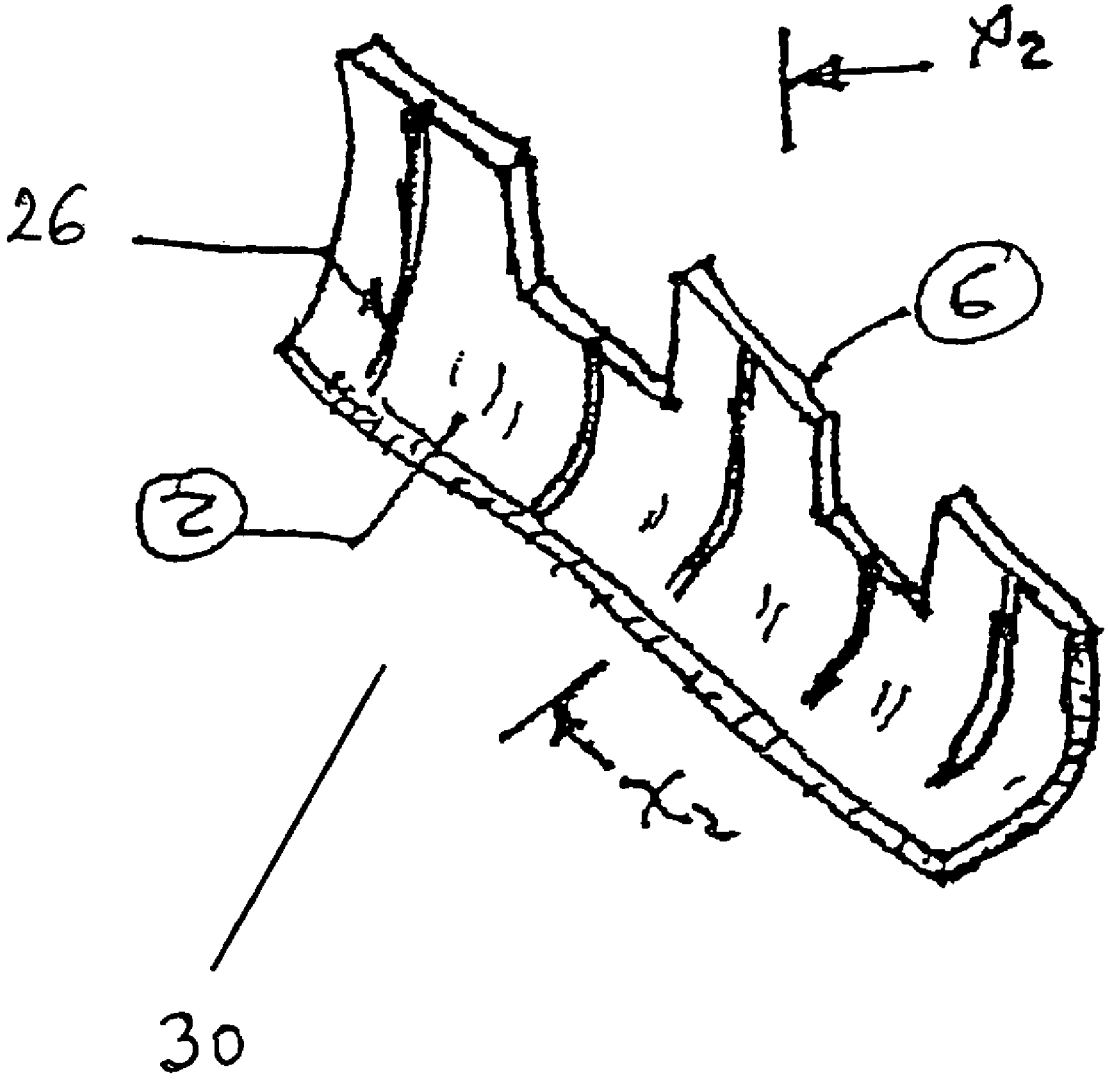
FIG. 5 Is a sectional perspective e inside view of the header with deformations on the inner side of the wall.
Figure 10:
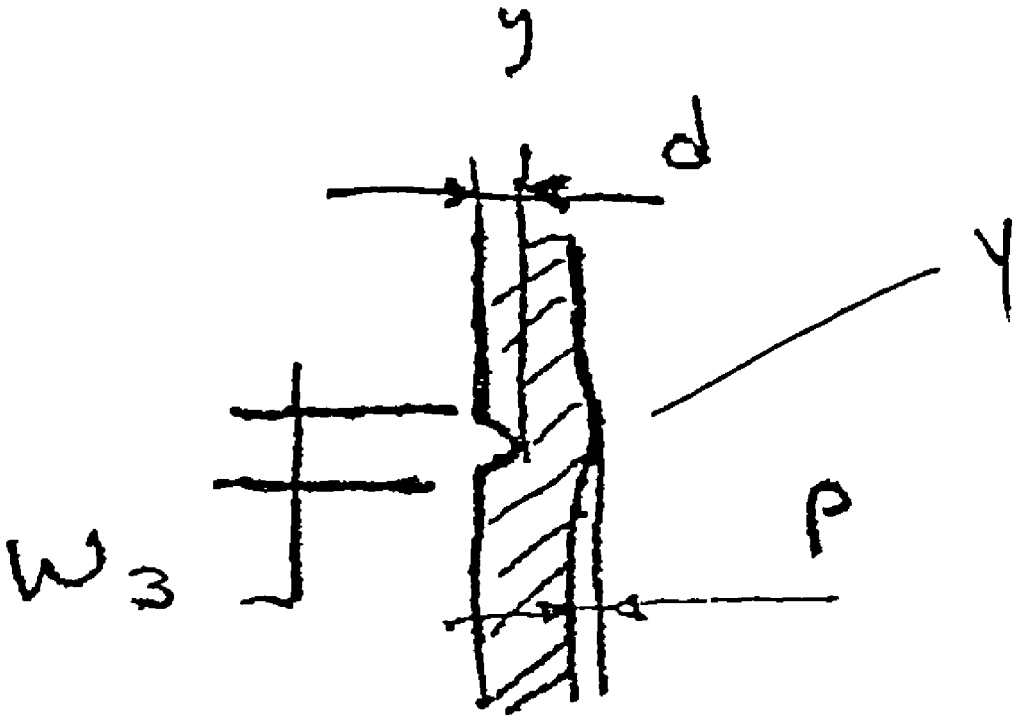
FIG. 10 is a cross sectional view of deformations of FIG. 6 in accordance with an aspect of the present invention.

As shown in FIG. 2 for the deformations made on the outer side of the wall Depth of the deformation (d), height (h) length (l) and width (w) (see also (w3) of FIG. 10) are measured to confirm adequate function.

In a preferred embodiment of the present invention, the (h) dimension can be from about 10% to the full size of the tooth (h1). The width (w) can be from 0.1 mm to the end of the curve of the inside radio (r) with the intersection of the sealing surface (s). The depth (d) dimension can be from about 0.1 mm to max of 50% of the material thickness of the header core. Width (w3) can be from 0.2 mm to 3.0 mm, or otherwise, depending on the actual configuration of the heat exchanger.

Referring to FIGS. 3-7 are additional preferred embodiments of the present invention. The tab (6) is bent into the shape of a hook (6*a*), is shown, with deformations (26) on header wall (30). Interior surface of wall (2) is also shown.

Figure 6:
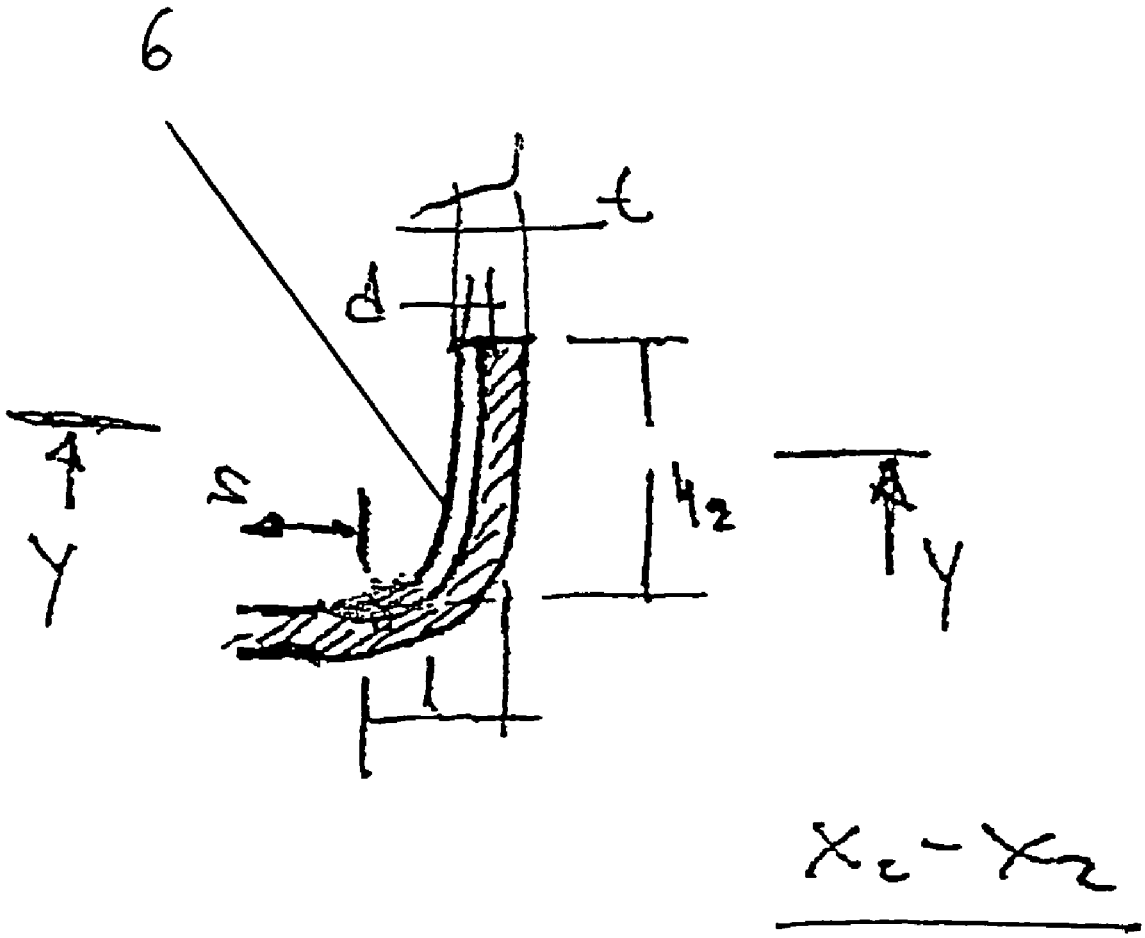
FIG. 6 Is a cross sectional view of the deformations on the inner side of the header wall.

FIG. 6 represents a cross sectional view of a tank, preferred embodiments showing deformations and increased side wall strength.

Figure 7:
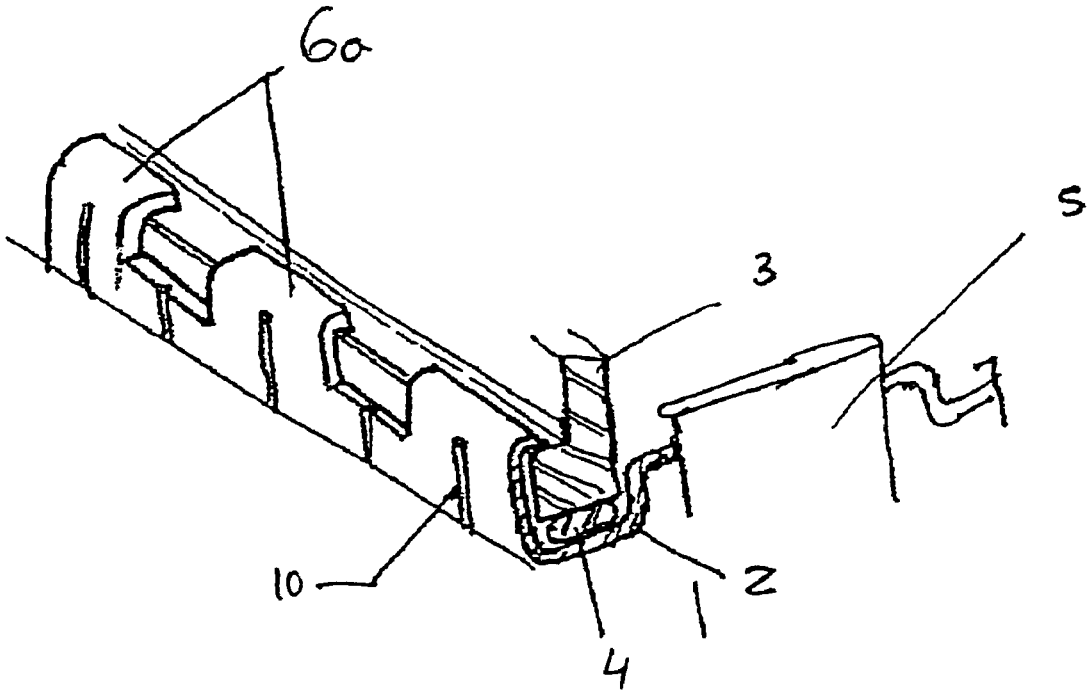
FIG. 7 Is a perspective view of a section of heat exchanger core, seal member and tank member. This view reflects the deformations on the outer side of the header wall.

FIG. 7 shows a perspective sectional view of the heat exchanger according to a preferred embodiment of the present invention. The plastic tanks members (3), rubber seal members (4) and tube (5), the aluminum core header (2,) is fixed respectively by bending the tab or tooth (6) of the outside wall of the header (2) producing hook (6*a*). This produces a plurality of hooks (6*a*) on the outer side wall.

Figure 8:
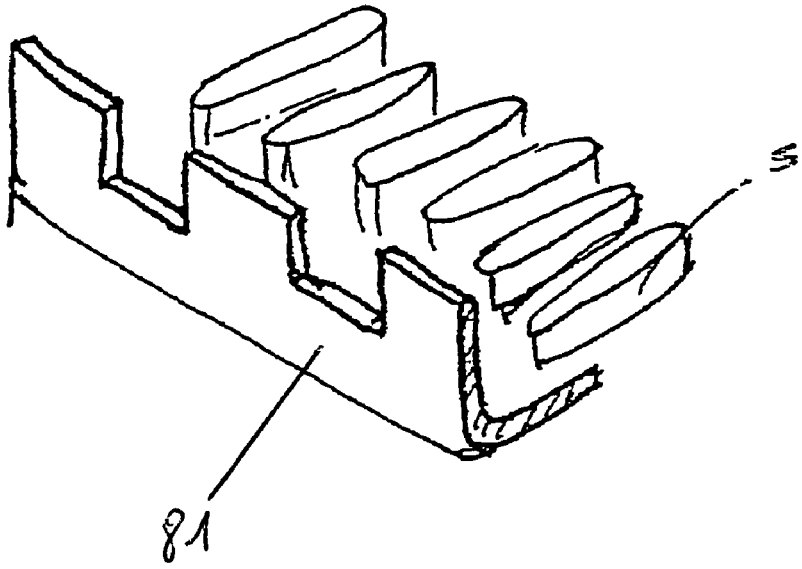
FIG. 8 PRIOR ART
FIG. 8 is a perspective view of the header and tank joint as exists in the prior art
Figure 9:
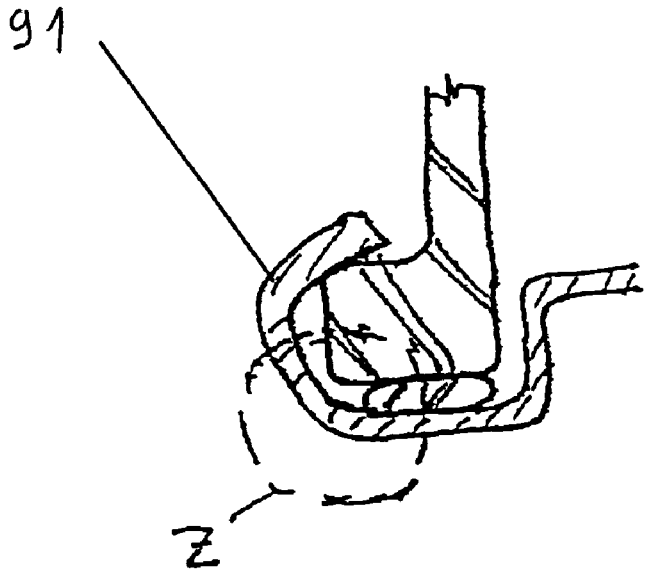
FIG. 9 PRIOR ART
FIG. 9 is a perspective view of the arrangement and tank joint as exists in the prior art.

Referring to FIG. 8 is shown tubes (S) a prior art header wall (81) that does not have deformations on the wall of the periphery. This prior art design is a less effective method to resist pressures into to heat exchanger. As shown in FIG. 9 when the prior art heat exchanger is subject to internal pressure the hooks (91) tend to open. The maximum stresses and deformation are produced at the zone marked in the circle Z of FIG. 9, and circle (d) of FIG. 13, during normal operation of heat exchanger. The rigidity (mechanical strength) of the outer wall of the header core is increased. In preferred embodiment of the present invention, deformation of the hooks (91) is reduced, thereby increasing the life of the heat exchanger to repetitive pressures.

Referring to FIG. 10, a cross sectional view of the deformations in shown, with deformations depth of and deformation width (w) illustrated. A slight distortion (y) on the inner surface of the header at the port of the deformations is shown.

Figure 11:
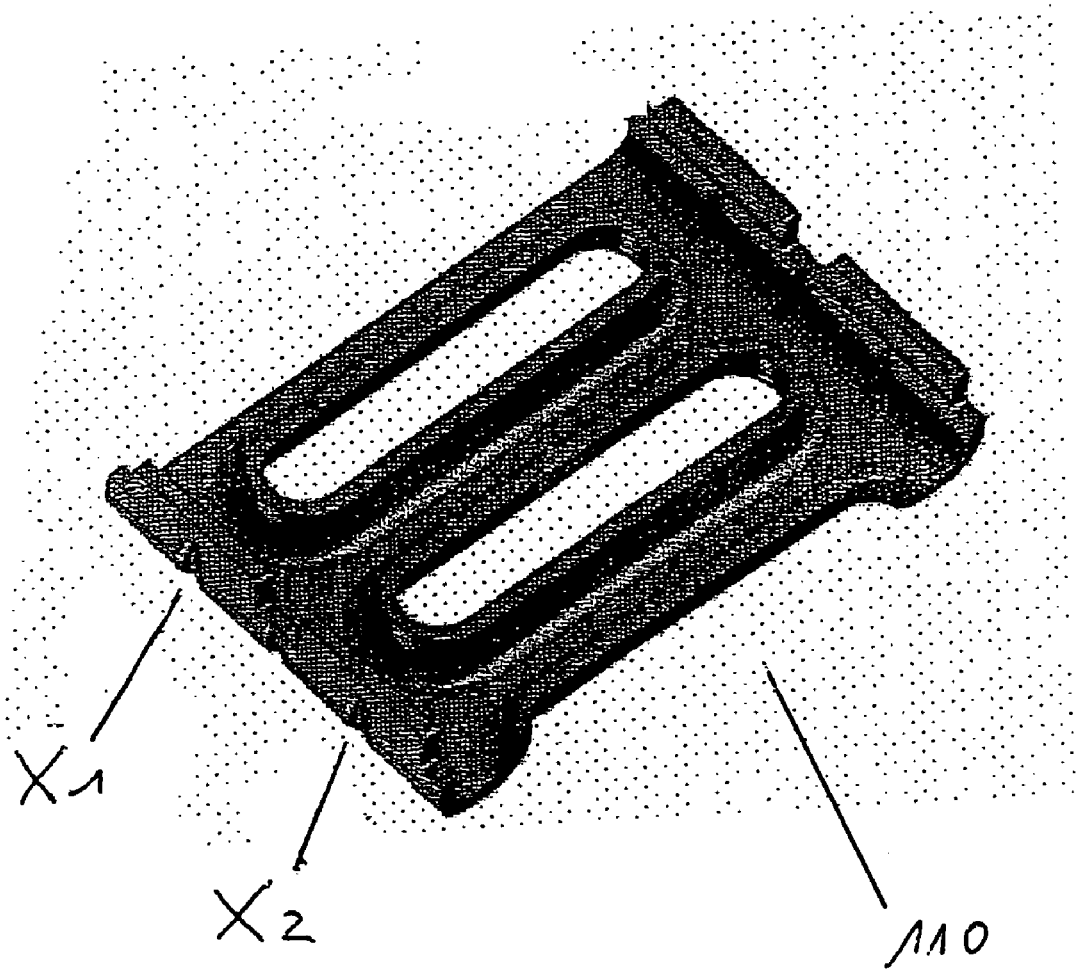
FIG. 11 is a view of a header section with deformations of FIG. 1, in accordance with an aspect of the present invention.

Referring to FIG. 11 is a view of the header section (110) showing deformations X1, X2 as reinforcement.

Figure 12:
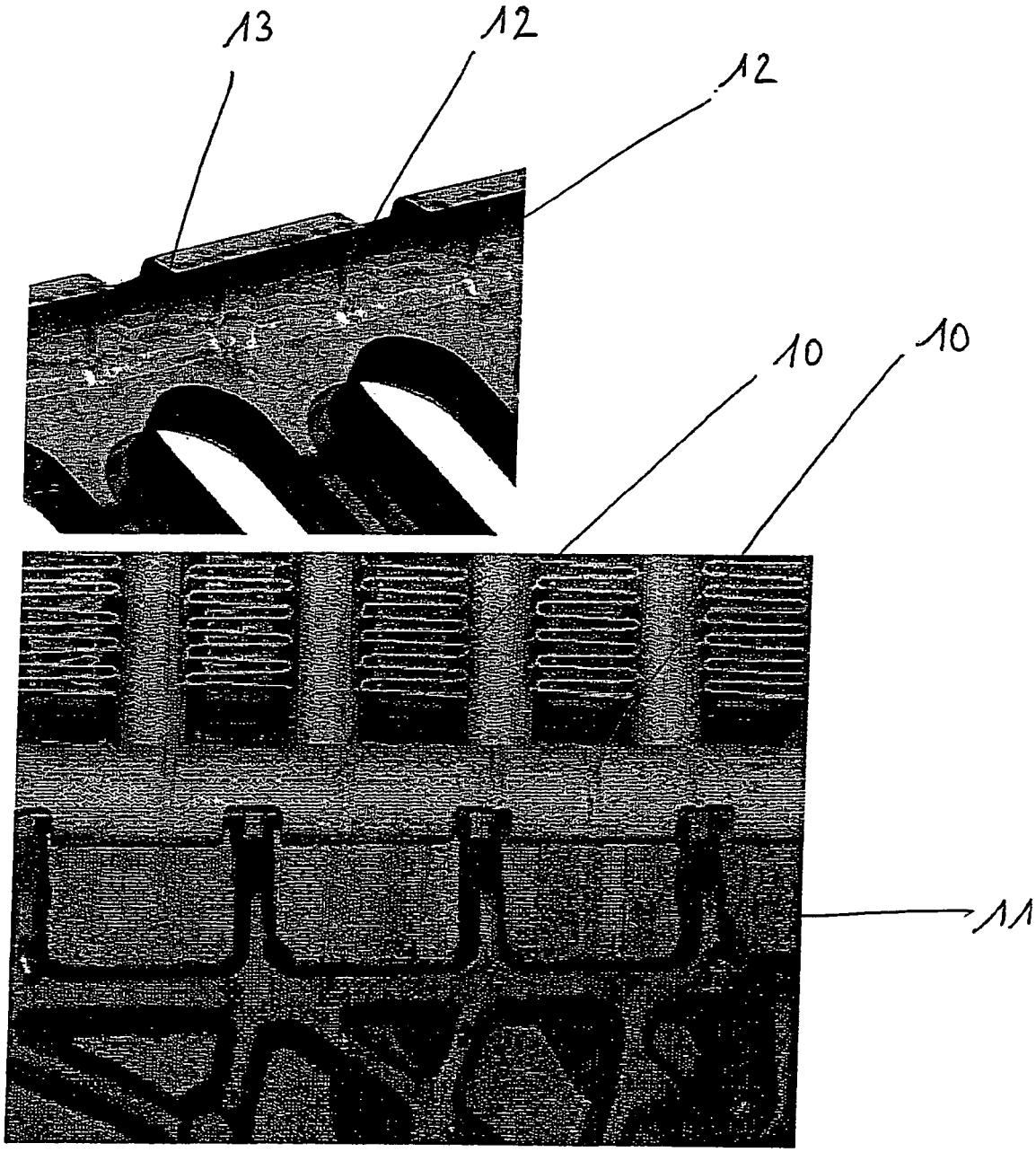
FIG. 12 is a view of the interior of a header where deformations are shown compressed into the header, in accordance with an aspect of the present invention.

Referring to FIG. 12 is interior section of header (13) where deformations have been pushed in from exterior (12)

are shown in CAC header with deformations (10) and plastic end tank (11) with tank crimped onto header.

Figure 13:
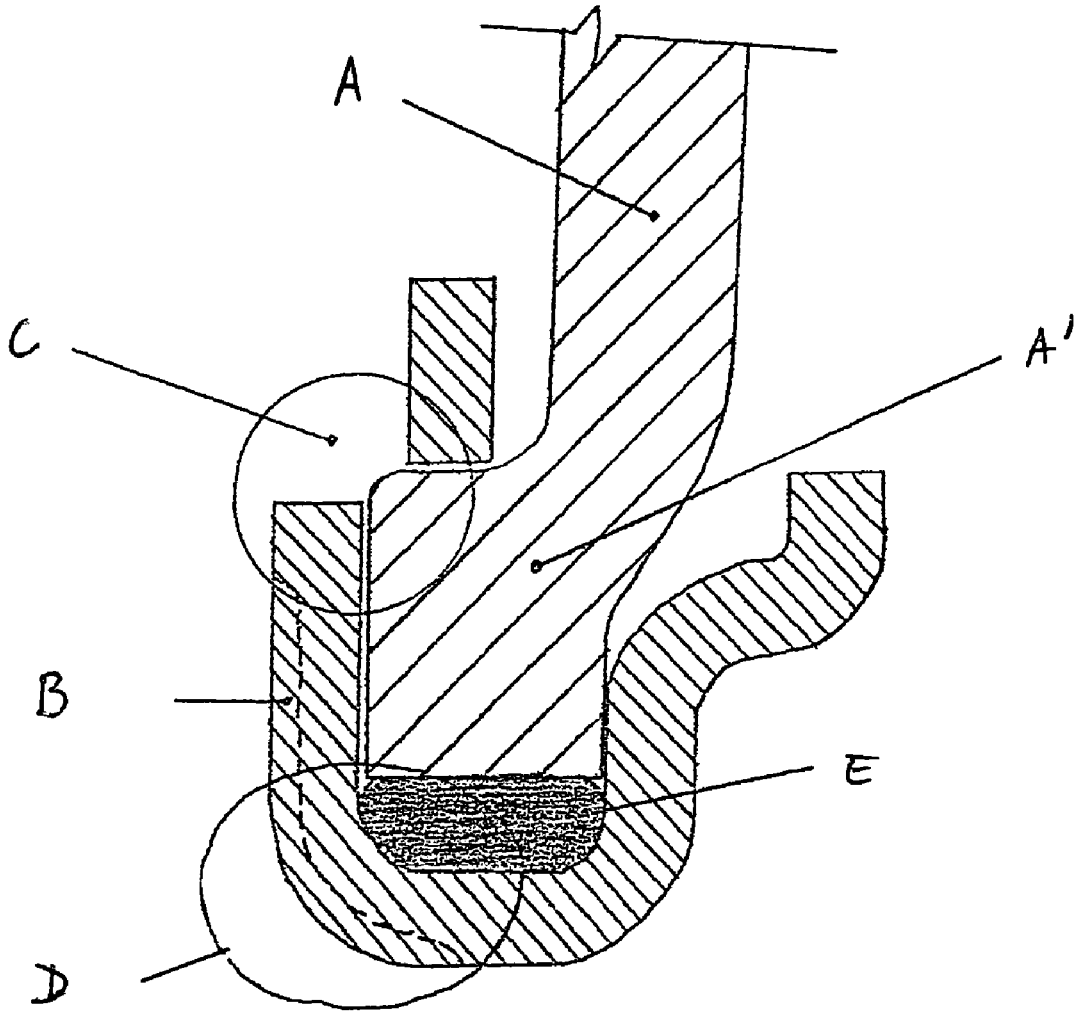
FIG. 13 is a view of a foot to header joint with gasket, denoting where deformations would be added to conform with an aspect of the present invention, and with non crimped or unbended hooks.

Referring to FIG. 13 is shown a plastic tank (A) with foot joint (A'), header side wall with rib added (B) and the area of the crimping (C) generated by a non-bended tooth type crimping, deforming a side wall against a plastic tank wall to produce a hook. Area of high stress and deformation under internal pressure of the heat exchanger located at area (D). Gasket (seal) (E) is also illustrated.

Figure 14:
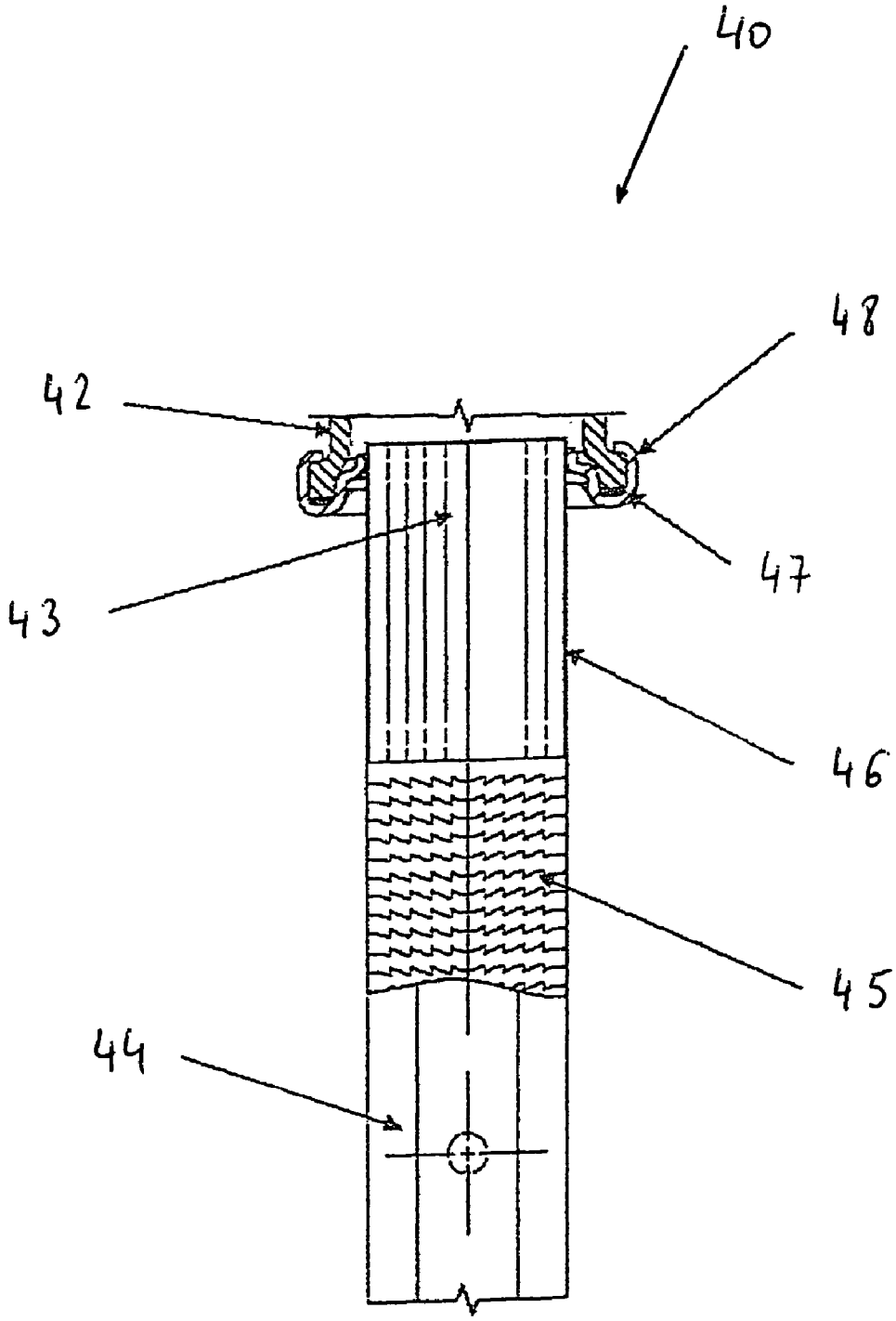
FIG. 14 is a side view of an aluminum header of the prior art crimped with a plastic end tank foot.

Referring to FIG. 14 is shown a typical heat exchanger (40) with header (48) crimped to form a hook, and gasket (47) correctly positioned. Also shown are tube (41), turbulator (43), tub assembly (46), fin (45), side plate (44) and end tank (42).

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The invention claimed is:

1. A brazed heat exchanger, comprising:

a plastic tank having a flange or foot portion at its open end;

a core portion having a plurality of tubes;

at least one header;

a header portion of the at least one header having a side wall, a bottom wall, and an outer side wall forming an area for receiving the flange or foot portion fixed to the core portion;

a plurality of hooks extending from the outer side wall of the header portion;

a basically leak tight tank to header joint;

a seal member disposed in between the wall area and the foot portion and the header; and at least one deformation formed in the outer side wall of the header portion at least between two of the plurality of hooks that are adjacent to each other;

wherein the header portion, foot portion, and sealing member form the basically leak tight tank to header joint, and wherein the plurality of hooks are crimped over the flange or foot portion to fix the tank member to the header to form the tank to header joint;

and wherein the at least one deformation is also formed on a radius linking the outer side wall and the bottom wall of said area for receiving the flange.

2. The heat exchanger as claimed in claim 1 wherein the at least one deformation is configured to increase stiffness in the side wall, which causes increased resistance to stress at the tank to header joint.

3. The heat exchanger as claimed in claim 1 wherein the at least one deformation is formed by compressing the outer surface of the side wall after the formation of the tank to header joint.

4. The heat exchanger as claimed in claim 3 wherein the compressing of the outer surface is achieved by using a specialized tool or jig.

5. The heat exchanger as claimed in claim 1 wherein the core portion and header portion are formed by a brazing process.

6. The heat exchanger as claimed in claim 5 wherein the at least one deformation is formed after the brazing process.

7. The heat exchanger as claimed in claim 6 wherein the core portion and header portion are made of aluminum or aluminum alloy.

8. The heat exchanger as claimed in claim 7 wherein the heat exchanger is a charge air cooler.

9. The heat exchanger as claimed in claim 3 wherein the heat exchanger is a radiator.

10. A heat exchanger, comprising:

at least one plastic end tank with a tank foot;

at least one sealing member;

at least one aluminum or aluminum alloy heat exchanger core having a central core portion and a header having at least one side wall; and at least one deformation formed in the at least one side wall and in a radius linking the at least one side wall to a bottom wall of the header at an area where the at least one side wall is in contact with the tank foot.

11. The heat exchanger as in claim 10 wherein the plurality of deformations is formed in an inner or an outer wall of the header.

12. The heat exchanger as claimed in claim 11 wherein the plurality of deformations is formed in the periphery of the header side walls.

13. The heat exchanger as claimed in claim 12 wherein the plurality of deformations is made after a brazing process.

14. The heat exchanger as claimed in claim 11 wherein the plurality of deformations is compressed inwardly or toward the interior of the header core.

15. The heat exchanger as claimed in claim 14 wherein the plurality of deformations is formed after brazing.

16. A method for making a reinforced brazed heat exchanger assembly, comprising:

forming a heat exchanger core by assembling tubes, fins, and header portions with a holding groove and a bottom and side wall for containing a tank foot, together as one unit;

brazing the heat exchanger core by conventional brazing techniques in order to form a basically leak proof unit;

compressing a plurality of deformations into the side wall of the header aligned with the tank foot after the brazing step, the plurality of deformations located on an outer side wall and on a radius linking the outer side wall and a bottom wall of the holding groove;

attaching a plastic end tank or manifold with a foot to the header portion of the unit;

creating a leak tight seal by placing a seal member or gasket in the holding groove; and joining a part of the header portion so that it holds the tank foot in place, thereby reinforcing the strength of the brazed heat exchanger assembly.

17. The method for making a reinforced brazed heat exchanger assembly as in claim 16 wherein the plurality of deformations is compressed on an exterior surface of the side wall towards an interior surface of the side wall.

18. The method for making a reinforced brazed heat exchanger assembly as in claim 16 wherein the method of joining is crimping.

19. The method for making a reinforced brazed heat exchanger assembly as in claim 18 wherein the plurality of deformations is compressed on an exterior surface of the side wall towards an interior surface of the side wall.

* * * * *